United States Patent [19]

van Laar et al.

[11] Patent Number: 5,031,882

[45] Date of Patent: Jul. 16, 1991

[54] CHANNEL STRUCTURE FOR FLOW OF MOLTEN PIG IRON

[75] Inventors: Jacobus van Laar, Driehuis; Frank Kaptein, Beverwijk; Ronald J. M. Stokman, Hillegom, all of Netherlands

[73] Assignee: Hoogovens Groep B.V., Ijmuiden, Netherlands

[21] Appl. No.: 524,967

[22] Filed: May 18, 1990

[30] Foreign Application Priority Data

Jun. 21, 1989 [NL] Netherlands ..... 8901556

[51] Int. Cl.[5] ..... C21B 7/10

[52] U.S. Cl. ..... 266/46; 266/191; 266/196; 266/280

[58] Field of Search ..... 266/46, 191, 196, 231, 266/280, 282, 286

[56] References Cited

U.S. PATENT DOCUMENTS 2,801,162 7/1957 Keeping ..... 266/231
4,350,325 9/1982 LaBate ..... 266/196
4,508,323 4/1985 Fleming ..... 266/196

FOREIGN PATENT DOCUMENTS 0060239 9/1982 European Pat. Off. .
0090761 10/1983 European Pat. Off. .
0143971 6/1985 European Pat. Off. .
0392093 12/1973 U.S.S.R. ..... 266/191

OTHER PUBLICATIONS

Patent Abstracts of Japan, vol. 5, No. 156 (C-74) [823] 10/6/81, "Spout for Molten Metal", T. Horio.

*Primary Examiner*—S. Kastler
*Attorney, Agent, or Firm*—Stevens, Davis, Miller & Mosher

[57] ABSTRACT

A channel structure, i.e. iron trough or iron runner, for flow of molten pig iron during tapping of a blast furnace, comprises a wear lining which provides the surface along which the iron flows, a permanent lining outside the wear lining and an outer lining of high thermal conductivity outside the permanent lining. The outer lining has a bottom wall and two opposed side walls thermally connected at their lower ends to the bottom wall. To improve resistance to thermal stress, outside and adjoining at least one, but not all, of the walls of the outer lining, there is at least one refractory insulating lining layer, and the other or others of the walls of the outer lining are thermally coupled to heat dissipating means.

13 Claims, 1 Drawing Sheet

CHANNEL STRUCTURE FOR FLOW OF MOLTEN PIG IRON

BACKGROUND OF THE INVENTION

1. Field of the Invention

This invention relates to a channel structure for flow of molten pig iron during tapping of a blast furnace, and also to a method of cooling such a structure. The channel structures employed for guiding the flow of molten pig iron from a blast furnace include firstly a main channel known as an "iron trough" which extends from the taphole and carries both iron and slag and secondly channels branching from said main channel known as "iron runners" and usually carrying either slag or iron.

2. Description of the Prior Art

Typically, such a channel structure comprises at least a wear lining which during operation provides a surface contacting the iron, a permanent lining in which the wear lining is contained, and a steel or concrete support outside the wear lining. A typical iron trough is for example ten to twenty meters long and three meters wide. Examples are shown in EP-A-90761 and EP-A-143971 where coolant passages are located in the lining layers, inwardly of the outer support, and EP-A-60239 where the metal support which is of channel shape has spaces in it for coolant, particularly air.

"Iron and Steel Engineer", October 1988, pages 47–51, especially FIG. 2 on page 48, describes a water-cooled iron trough having a wear lining, an alumina permanent lining, two carbon layers of high thermal conductivity outside the permanent lining and a steel box of channel shape which is water-cooled on all three sides.

It is noted here that the present invention is not limited to water-cooled channel structures, but also relates to air-cooled structures, and to structures which are cooled in other ways, for example with a glycol/water mixture, as is also described in the same article in the "Iron and Steel Engineer".

The wear lining of an iron trough or runner may for example consist of a refractory concrete. Carbon in Combination with aluminium oxide bricks may be used for the permanent lining, or for example just aluminium oxide bricks. The outer lining between the steel outer boundary of the permanent lining is for example made of graphite, carbon or semi-graphite.

On account of strength considerations, the steel of the outer support should achieve no temperature higher than about 200° C. The pig iron comes out of the blast furnace directly into contact with the wear lining and has a temperature of about 1450° C.–1550° C. As a result substantial thermal stresses occur in the structure. The way in which this thermal load is accommodated in the design of the iron trough or runner largely determines the life of the iron runner.

A problem can for example be that, as a consequence of the thermal stresses, the iron trough or runner begins to crack, as described in copending application U.S. Pat. No. 447053 filed 5th January 1990 and not yet published and also copending European application 89203088, Australian application 46940/89 and Indian application 917/MAS/89, not yet published. This cracking leads to the defect that escaping liquid pig iron fills a space on the outside of the steel support, which makes repair expensive. To carry out the repair the iron trough or runner has to be removed completely at the position of the breakout in order to be able to remove the now solidified pig iron. After that the trough or runner has to be fitted again. All this is expensive. It also occurs that, because the trough or runner overflows, liquid pig iron falls into a space between the steel support and the "shore" which supports the iron trough or runner. Then too the solidified pig iron has to be removed and this has the same drawbacks as mentioned above.

SUMMARY OF THE INVENTION

The object of the invention is to prevent or reduce these problems and particularly to provide a channel structure for flow of molten pig iron which accommodates thermal stress well and is less liable to crack.

A channel structure for flow of molten pig iron during tapping of a blast furnace according to the invention comprises a wear lining which provides a channel-shaped surface along which the iron flows, a permanent lining outside the wear lining and an outer lining of high thermal conductivity outside the permanent lining. The outer lining has a bottom wall and two opposed side walls thermally connected at their lower ends to the bottom wall. Outside and adjoining at least one, but not all, of said walls of said outer lining is at least one insulating lining layer. The other or others of said walls of said outer lining are thermally coupled to heat dissipating means. The insulating lining layer or layers are preferably at least partly of refractory material.

The method in accordance with the invention of cooling a channel structure along which molten pig iron flows during tapping of a blast furnace, said channel comprising a wear lining, a permanent lining and an outer lining as described above, is characterized by cooling at least one, but not all, of the walls of said outer lining, while restricting outward heat flow through the other or others of said walls.

It is for example conceivable that the horizontal bottom wall of the outer lining is not directly cooled but adjoins directly the insulating lining layer outside it, while all heat to be dissipated through the two side walls of the outer lining is led away by a water- or air-cooling of the side walls. In this case, to prevent inflow of overflowing pig iron from the iron runner on both sides of the side walls of the channel structure, horizontal cover plates may be arranged on top of the channel structure.

However, it is preferred for the two side walls to adjoin directly insulating lining layers outside them and for the bottom wall to be coupled to the heat dissipating means which are adapted for dissipating heat from the bottom wall. Thus the side walls are cooled via the bottom wall, with which they are in thermal contact.

The invention is thus based on the daring conception of dissipating all heat to be dissipated via at least one, but not all, of the walls of the outer lining and preferably via the bottom wall. The conventional concept as known for example from the above-mentioned article in "Iron and Steel Engineer" in which all outer walls of the iron trough contribute directly to the heat dissipation, is abandoned.

Surprisingly, it has been found that the reduced cooling of the outer lining is small, and does not affect the performance of the structure. Because the outer lining is highly conductive, it is not overheated at the parts which are not directly cooled.

In the channel structure in accordance with the concept of the invention, it is essential that the side walls of the outer lining are thermally coupled to the bottom wall of the outer lining. Then in the preferred embodiment of the invention, it is possible for the side walls to adjoin directly the insulating lining layers outside them. Heat dissipation then is effected by conduction from the side walls to the bottom wall. In this preferred embodiment, the spaces on both sides of the channel structure can no longer be filled with pig iron, since these spaces are now completely filled by the lining layers outside the side walls.

It is desirable that the outer lining has a coefficient of thermal conductivity higher than about 29 W/mK. Preferably the outer lining is then made of graphite.

To increase the life of the channel structure, it is preferred that between the permanent lining and at least part of the outer lining one or more compressible material layers, e.g. felt layers, for taking up expansion of the structure during operation. Further it is for the same reason desirable that the channel structure is at least partly provided with a layer of compressible material on the outermost side of the insulating lining layers.

The channel structure can advantageously be embodied with just a steel bottom plate as the outer support. This steel bottom plate serves as a foundation for the construction of the structure. In that case it is desirable that a thin separating layer with a low coefficient of thermal conductivity is incorporated between the steel bottom plate and the outer lining, in such a way that the temperature of the steel bottom plate does not exceed the desired maximum temperature of 200° C., while this thin partition layer transmits heat sufficiently to the steel bottom plate to achieve the desired cooling of the outer lining. It is sufficient for the partition layer to have a coefficient of thermal conductivity of in the range 1 to 5 W/mK, preferably 1 to 2 W/mK.

Preferably the heat dissipating means are adapted to dissipate heat from the steel bottom plate by forced air cooling. The underside of the channel structure, that is the steel bottom plate, and the surrounding parts on which the runner is supported, may form a slot or slots through which cooling air can be led for the dissipation of heat from the steel bottom plate. It is possible to achieve this by connecting a suction fan to one side of said slot. The best results, however, are obtained if the heat dissipating means comprise means for applying an excess pressure on the entry side for the cooling air. It is possible then to lead a much larger flow of cooling air along the steel bottom plate than when applying a suction fan.

BRIEF INTRODUCTION OF THE DRAWING

In the following the invention will be illustrated by a non-limitative example of embodiment of the channel structure in accordance with the invention, described with reference to the drawing, in which FIG. 1 shows a cross-section of an iron runner in accordance with the invention. A similar structure can be applied to an iron trough in accordance with the invention.

DESCRIPTION OF THE PREFERRED EMBODIMENT

Figure 1:
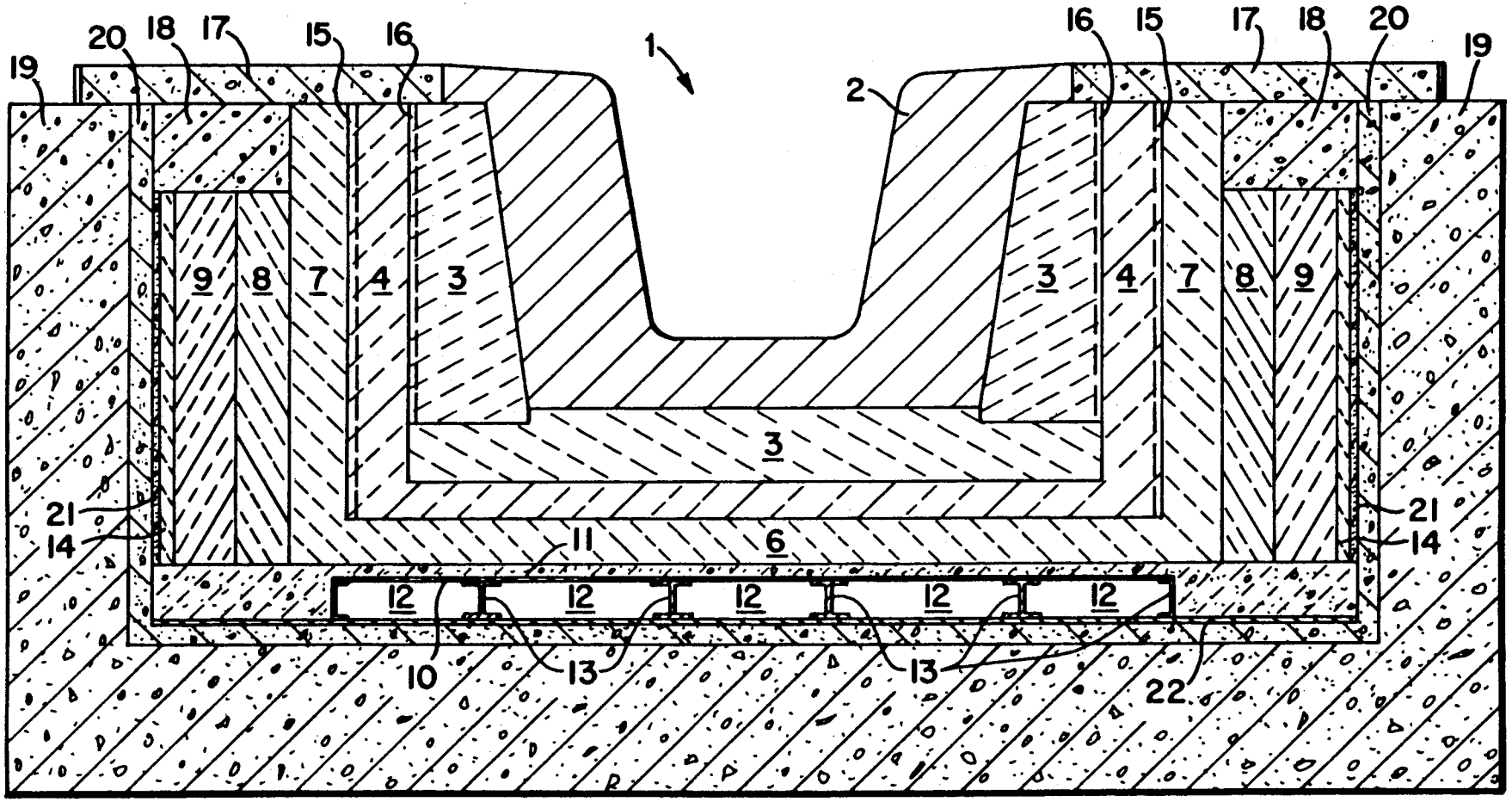

In FIG. 1 there is shown the iron runner 1 of which the channel-shaped surface carrying the molten iron flowing from the tap hole of a blast furnace is formed by a wear lining 2. For the wear lining 2, which may consist of a number of layers able to move relative to each other, various kinds of material may be used, but it is normal to use a refractory concrete. Directly adjoining the wear lining 2 at its outside is a carbon intermediate lining 3 of amorphous carbon bricks, forming a permanent lining for temperature equalization of the wear lining 2. Adjoining this intermediate lining 3 on its outside there is an insulating layer 4 of a refractory concrete. Outside the insulating layer 4 there is a brick outer lining consisting of two opposed side walls 7 and a bottom wall 6. The insulating layer 4 prevents the temperature of the outer lining 6,7 from exceeding approx. 600° C.

To accommodate the thermal expansion of the structure of the iron runner during operation, the runner is further provided with compressible ceramic felt layers 15,16 between the side walls 7 of the outer lining and the insulating layer 4, and between the side walls of the insulating layer 4 and the intermediate lining 3 respectively.

The outer lining 6,7 is composed of thermally conductive material and the bottom wall 6 and side walls 7 are thermally interconnected. The bricks are arranged to provide good heat flow, i.e. without insulating layers in them. If interstices are present, they are filled with highly conductive mortar. By using carbon, graphite or semi-graphite, but preferably graphite for the bricks of the outer lining 6,7, sufficient thermal conductivity is achieved in it particularly at the connections of the side walls 7 to the bottom wall 6, so that it is possible to apply insulating lining layers 8,9 directly joining the side walls 7, while removing heat only through the bottom wall 6 as described below. The layer 8 is refractory and is made of high-alumina concrete. The layer 9 need not be refractory, and is made of a highly insulating concrete of non-refractory properties.

In order to provide an expansion possibility it is further desirable that the iron runner is provided with a layer 14 of compressible material on the exterior side of lining layers 8,9 at the position of the side walls. The layer 14 is of ceramic felt.

At its lower side the iron runner is provided with a supporting steel bottom plate 10. Between this plate and the bottom wall 6 of the outer lining is a partition layer 11 in the form of a thin insulation layer 11 of for example a kind of refractory concrete. The thickness and thermal conductivity of this layer are chosen so that it conducts sufficient heat to the steel plate 10 but prevents the temperature of the steel plate 10 from exceeding about 200° C.

This thin layer 11 of low thermal conductivity has an important function. Iron runners or troughs suffer from for instance cracking of the wear and permanent linings. The possibility then arises that liquid iron reaches the lower parts of the runner or trough. In that case graphite layer 6,7 performs a safety-function by freezing this liquid iron to solid state. If the thin layer 11 was not present, there would be a severe and very local thermal load to the steel plate 10 adjacent to the graphite layer. This would cause the steel plate to be ruined very quickly. The layer 11 provides for the spreading of the thermal load of the graphite layer, and as a consequence the steel plate has an extended life-time.

Cooling of the iron runner is done by forced air cooling or water cooling or the like of the steel bottom plate 10. In the embodiment illustrated, forced air cooling is employed. Cooling air is blown through slots 12 between the steel bottom plate 10 and the structure on which the iron runner is supported (by sections 13), for the dissipation of heat from the steel bottom plate 10. The blowing means, e.g. a fan, is upstream of the slots 12 in the air flow direction. The steel plate 10 has a thickness of about 0.7 cm but may be thicker.

As mentioned, the layers 3,6 and 7 are made of bricks. The remaining layers 2,4,8,9,11 so far described are castable material. As indicated above, the thermal conductivities of the various layers are selected in accordance with their functions as good or poor thermal conductors. In the embodiment described, the thermal conductivities of the materials chosen fell within the following ranges, which are preferred:

| Layer | Thermal conductivity (W/mK) |
|---|---|
| 2 | about 2 |
| 3 | 5–15 |
| 4 | 1–5 |
| 6, 7 | 50–100 |
| 8 | 1–5 |
| 9 | 0.5–1 |
| 11 | 1–5, particularly about 2. |

The iron runner illustrated also has covers 17 of high-alumina castable concrete at each side, to prevent any liquid iron, which spills out of the flow channel, from contacting the layers 3,4,7,8,9. Particularly the highly insulating layers 8,9 may not have refractory properties and may not survive contact with liquid iron. To protect them further, a layer 18 is provided above them, made of castable high-alumina concrete.

Outside the channel structure thus far described is shown a concrete construction 19 which in practice may be an existing structure in which the iron runner is built. At its inside, there is a layer 20 of concrete and thin layers 21 and 22 of mortar and high alumina concrete to provide a smooth surface for the assembly of the iron runner.

What is claimed is:

1. Channel structure for flow of molten pig iron during tapping of a blast furnace comprising (i) a wear lining having a channel-shaped surface along which the iron flows, (ii) a permanent lining of channel shape outside said wear lining, (iii) an outer lining of high thermal conductivity outside said permanent lining and comprising three walls in the form of a bottom wall and two opposed side walls which have lower ends and are thermally connected at said lower ends to said bottom wall, (iv) at least one thermal insulating lining layer outside and adjoining at least one, but not all three, of said three walls of said outer lining, and (v) heat dissipating means for cooling said outer lining layer thermally coupled to the one or each one of said three walls of said outer lining which is not adjoined by a said insulating lining layer.

2. Channel structure according to claim 1 wherein said side walls of said outer lining have said insulating lining layers at their outside, while said bottom wall is thermally connected to said heat dissipating means.

3. Channel structure according to claim 1 wherein said outer lining has a thermal conductivity of more than 29 W/mK.

4. Channel structure according to claim 1 wherein said outer lining is made of graphite.

5. Channel structure according to claim 4 wherein at least one layer of compressible material for accommodating thermal expansion is provided between said permanent lining and at least part of the outer lining.

6. Channel structure according to claim 1 wherein a layer of compressible material is provided outside at least part of said insulating lining layers.

7. Channel structure according to claim 1, having a supporting steel bottom plate forming a part of said heat dissipating means.

8. Channel structure according to claim 7 having a thin partition layer of lower thermal conductivity than said outer lining between the outer lining and the steel bottom plate.

9. Channel structure according to claim 8 wherein the thermal conductivity of said partition layer is in the range 1 to 5 W/mK.

10. Channel structure according to claim 7 wherein said heat dissipating means includes means for forced air cooling of said bottom plate.

11. Channel structure according to claim 10 wherein said means for forced air cooling includes means for applying over-pressure to the cooling air on the upstream side of the bottom plate in the air flow direction.

12. Method of cooling a channel structure along which molten pig iron flows during tapping of a blast furnace, said channel structure comprising (i) a wear lining having a channel-shaped surface along which the iron flows, (ii) a permanent lining of channel shape outside said wear lining, (iii) an outer lining of high thermal conductivity outside said permanent lining and comprising three walls in the form of a bottom wall and two opposed side walls which have lower ends and are thermally connected at said lower ends to said bottom wall, said method comprising cooling at least one, but not all three, of said three walls of said outer lining while restricting heat flow outwardly through the or each other of said three walls.

13. Method according to claim 12 which consists in cooling said bottom wall of said outer lining while restricting outward heat flow through both said side walls of said outer lining.

* * * * *